US011236909B2

(12) United States Patent
Duffy

(10) Patent No.: US 11,236,909 B2
(45) **Date of Patent: *Feb. 1, 2022**

(54) ORIFICE HOLDER MOUNTING SYSTEM FOR GAS COOKTOP

(71) Applicant: Whirlpool Corporation, Benton Harbor, MI (US)

(72) Inventor: Patrick J. Duffy, Ann Arbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 23 days.

This patent is subject to a terminal disclaimer.

(21) Appl. No.: 16/879,145

(22) Filed: May 20, 2020

(65) Prior Publication Data

US 2020/0278114 A1 Sep. 3, 2020

Related U.S. Application Data

(63) Continuation of application No. 15/383,080, filed on Dec. 19, 2016, now Pat. No. 10,697,641.

(51) Int. Cl.
*F24C 3/02* (2006.01)
*F24C 3/08* (2006.01)

(52) U.S. Cl.
CPC ..... *F24C 3/02* (2013.01); *F24C 3/085* (2013.01)

(58) Field of Classification Search
CPC ..... F24C 3/082; F24C 3/085
USPC ..... 126/39 R, 39 E, 39 B
See application file for complete search history.

(56) References Cited

U.S. PATENT DOCUMENTS

| | | | | |
|---|---|---|---|---|
| 917,186 | A | 4/1909 | Thompson | |
| 1,648,789 | A | 11/1927 | Stockstrom | |
| 3,597,135 | A | 8/1971 | Kweller | |
| 4,846,671 | A | 7/1989 | Kwiatek | |
| 5,623,917 | A | 4/1997 | Dinaso et al. | |
| 6,817,353 | B2 | 11/2004 | Atkinson et al. | |
| 9,297,537 | B2 | 3/2016 | Hensley et al. | |
| 10,697,641 | B2 * | 6/2020 | Duffy | F24C 3/02 |
| 2014/0261385 | A1 | 9/2014 | Kadus et al. | |
| 2015/0090249 | A1 | 4/2015 | Acosta Herrero et al. | |
| 2015/0159880 | A1 | 6/2015 | Gen | |

FOREIGN PATENT DOCUMENTS

| | | |
|---|---|---|
| FR | 2404803 | 4/1979 |

* cited by examiner

*Primary Examiner* — Vivek K Shirsat
(74) *Attorney, Agent, or Firm* — Diederiks & Whitelaw, PLC.

(57) ABSTRACT

A compact non-rotational mounting feature or mechanism is employed for mounting an orifice holder to a support member below a cooktop of a gas cooking appliance. More specifically, the holder and support member include interengaging polygonal structure, such as a key-shaped anti-rotational peg and hole combination, allowing the holder to be initially mated with the support member in a manner which prevents relative rotation and assuring that the holder is appropriately positioned for proper alignment of various gas burner components, such as an orifice, a gas line, electrode, flame spreader and other burner related structure. Upon exacting the positioning of the holder relative to the support member, the holder to fixed in position by a mechanical fastener.

20 Claims, 5 Drawing Sheets

ORIFICE HOLDER MOUNTING SYSTEM FOR GAS COOKTOP

CROSS REFERENCE TO RELATED APPLICATIONS

This application represents a continuation application of application Ser. No. 15/383,080, titled "Orifice Holder Mounting System for Gas Cooktop" and filed Dec. 19, 2016. The entire content of this application is incorporated herein by reference.

BACKGROUND OF THE INVENTION

Field of the Invention

The present invention pertains to the art of cooking and, more particularly, to a mounting assembly employing an anti-rotation feature for securing a gas orifice holder to support structure for a cooktop of a gas cooking appliance.

Description of the Related Art

In the art of cooking, both gas and electric cooktops are commonplace. The cooktop can be provided as part of a range or separately mounted in a countertop. In the case of a gas range, a plurality of burners are mounted at spaced locations about a top of the range. In most cases, the burners are mounted in openings formed in the cooktop. In some designs, the burners can actually be sealed to the cooktop to provide a streamlined appearance to facilitate cleaning and maintenance. In other designs, the burners are generally mounted to structure below the cooktop and project through the openings. For instance, it is known to mount a bracket to a burner box below the cooktop and secure a burner, as well as an end portion of a gas supply line, to the bracket, specifically through the use of an orifice holder and a plurality of mechanical fasteners. Although effective and reliable, such a mounting arrangement is quite labor intensive in connection with the overall assembly of the cooking appliance. The invention seeks to address this situation by presenting an alternative orifice holder mounting arrangement.

SUMMARY OF THE INVENTION

The present invention is directed to the mounting of an orifice holder for a burner in a gas cooking appliance. More specifically, a non-rotational mounting feature or mechanism is employed for mounting the orifice holder to a support member below a cooktop. The non-rotational mounting feature is actually established between the support member and the orifice holder which, in turn, is attached to the burner. More specifically, the holder and support member include interengaging structure, allowing the holder to be initially mated with the support member in a single, predetermined orientation and in a manner which prevents relative rotation. In making this connection, interconnecting polygon structure is employed to assure the holder is appropriately positioned for proper alignment of various gas burner components, such as an orifice, a gas line, electrode, flame spreader and other burner related structure. Upon exacting the positioning of the holder relative to the support member, the holder to fixed in position by at least one mechanical fastener.

In a particular embodiment of the invention, the interconnecting polygonal structure is constituted by a key-shaped anti-rotational peg and hole combination. For instance, the support member, which can be constituted by a burner box, a bracket attached to the burner box or a base of an upstanding plateau member projecting from a burner box, includes a key-shaped hole, while a key-shaped projection extends from the orifice holder. With this arrangement, the orifice holder can only be positioned relative to the support member in a single position, thereby assuring the proper orientation of the orifice holder for the connection of the various gas burner components.

Additional objects, features and advantages of the invention will become readily apparent from the following detailed description of preferred embodiments of the invention when taken in conjunction with the drawings wherein like reference numerals refer to corresponding parts in the several views.

DETAILED DESCRIPTION OF INVENTION

Figure 1:
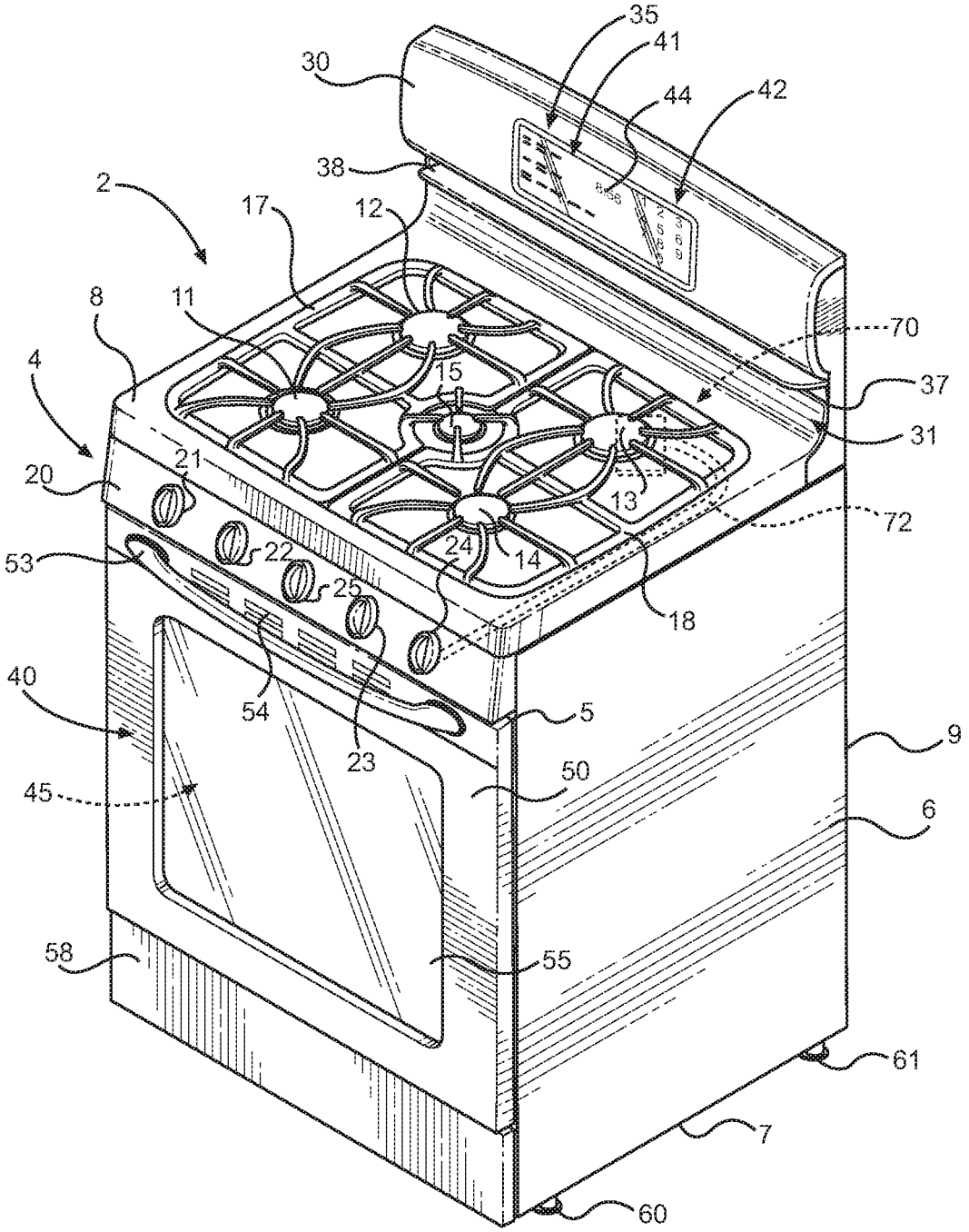
FIG. 1 is a perspective view of a range incorporating the mounting system of the present invention.

With initial reference to FIG. 1, the present invention is shown incorporated into a cooking appliance generally indicated at 2. As illustrated, cooking appliance 2 takes the form of a free-standing gas range. Range 2 includes a cabinet 4 having a front panel portion 5, opposing side panel portions 6, a bottom portion 7, a cook or range top 8 and a main back panel 9. Within the scope of the invention, range top 8 can take on various forms. In the preferred embodiment shown, range top 8 is provided with five gas burner elements 11-15, i.e., four outer quadrant gas burner elements 11-14 and a central gas burner element 15, which are covered by left and right, mirror image burner grates 17 and 18.

In the embodiment illustrated, cabinet 4 further includes a front control surface 20 supporting a plurality of control knobs 21-25 for controlling the activation/de-activation of gas burners 11-15 respectively. Furthermore, cabinet 4 includes an upstanding control panel 30 arranged at an upper rear portion 31 of cabinet 4. In the embodiment shown, control panel 30 includes a central control and display unit, generally indicated at 35. Control panel 30 is provided above an exhaust outlet opening 37 extending across upper rear portion 31 and having an associated exhaust deflector 38 for directing an exhaust airflow away from control panel 30 and central control and display 35.

In the exemplary embodiment shown, central control and display 35 is provided for use in controlling an oven 40 of range 2. Although not fully detailed in this figure, control and display unit 35 includes a first control section 41 for selecting a desired cooking operation for oven 40. By way of example, control and display unit 35 could enable a user to select between warm, convection bake, bake, convection broil, broil and cleaning operations. In connection with setting desired cooking parameters, control and display unit 35 also includes a second control section 42 which defines a numeric key pad. At this point, it should be realized that the arrangement and features associated with control panel 30 can vary without departing from the invention. For instance, in addition to other standard controls, such as timer and clock setting elements, control panel 30 can provide for other operations known in the art. In any event, control and display unit 35 further includes a central display 44 for conveying information to and verifying input/operational parameters to a user.

As depicted, oven 40 includes an oven cavity 45 and has associated therewith a door 50 which can be pivoted by means of a handle 53. Door 50 preferably includes a plurality of vents 54 arranged behind handle 53 and a window 55 for viewing the contents of oven cavity 45 when door 50 is closed. Arranged below door 50 and extending across cabinet 4 is a lower face panel 58.

In a manner known in the art, range 2 is adapted to be mounted upon a supporting surface, such as a kitchen floor or the like. More specifically, a plurality of leg members, two of which are indicated in FIG. 1 at 60 and 61, extend from bottom portion 7 at front and rear portions of cabinet 4, along side panel 6. Of course, corresponding leg members 60 and 61 are also provided on the opposing side of range 2. In any event, the various leg members 60 and 61 are preferably vertically adjustable to also act as levelers for range 2. Such leg leveler arrangements are widely known in the art of appliances, including ranges, dishwashers and refrigerators. At this point, it should be noted that the above-referenced structure is known in the art and has been shown and described for the sake of completeness. Instead, the invention is actually directed to an orifice holder mounting system 70 for one or more of burners 11-15 of cooktop 8, particularly a mounting system 70 including a polygon anti-rotational mounting arrangement to assure the proper attachment of various gas burner components, including a gas supply line 72 regulated through control knob 24 as will be more fully discussed below.

Figure 2A:
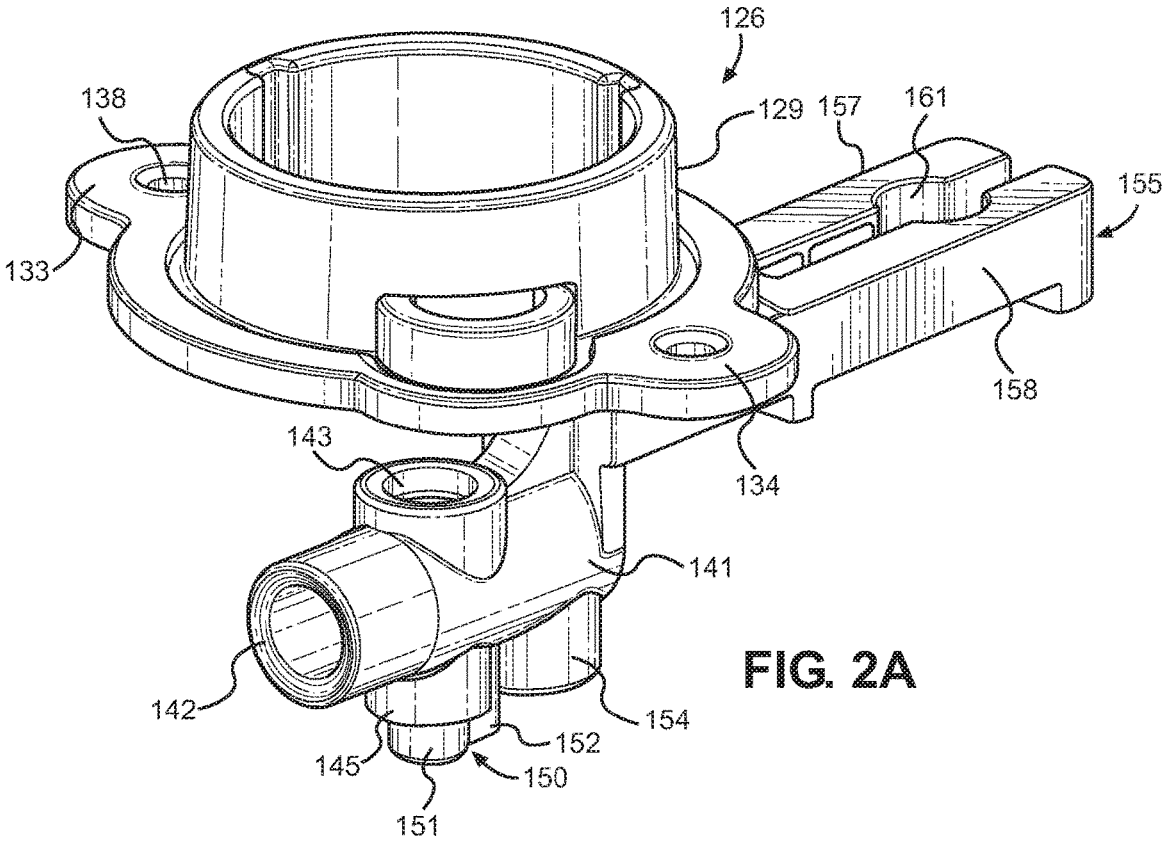
FIG. 2A is an upper perspective view of an orifice holder of the mounting system of FIG. 1.
Figure 2B:
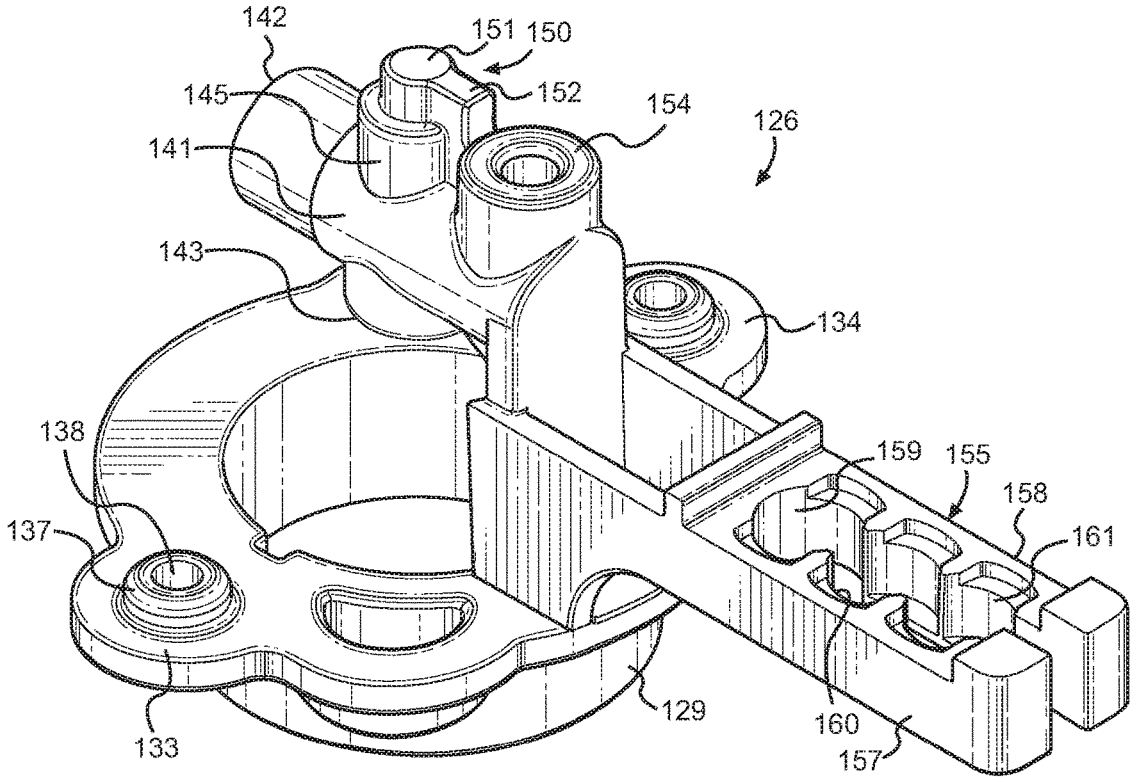
FIG. 2B is a lower perspective view of the orifice holder of FIG. 2A.

With reference to an embodiment of the invention shown in FIGS. 2A and 2B, an orifice holder 126 is depicted, including an upper body portion 129 from which project a pair of side flanges 133 and 134. Each side flange 133, 134 is provided with an associated mounting boss 137 (seen in FIG. 2B only) having a bore 138. Below upper body portion 129 is a lower body portion 141 which includes a first port 142 for attaching gas supply line 72 and a second port 143 for receiving an orifice element (not shown). Opposite second port 143, lower body portion 141 includes a mounting boss 145 from which projects polygonal-shaped connecting structure generally indicated at 150. As will be more detailed more fully below, polygonal-shaped connecting structure 150, which as shown includes peg structure having a circular portion 151 and a polygonal portion 152 that projects from circular portion 151, is important in connection with establishing a compact anti-rotational mounting feature or mechanism of the invention. In any case, the mounting bosses 137 in the side flanges 133 and 134, as well as a mounting boss 154, are used for mounting purposes. In accordance with one preferred mounting arrangement (further details of which will be presented below), a mechanical fastener (not shown) is threaded within mounting boss 154 in securing orifice holder 126 in place, cook top 8 is then fastened to orifice holder 126 at side flanges 133 and 134, and a respective burner 11-15 is positioned in a ring (not separately labeled) of orifice holder 126 above second port 143. Certainly, other mounting arrangements are possible. For instance, burners 11-15 can be fixed to the orifice holder 126 at the mounting bosses 137 of the side flanges 133 and 134 and, for larger burners such as burner 12, an additional fastener (not shown) can also extend with mounting boss 154.

Extending at a position between upper body portion 129 and lower body portion 141 of holder 126 is a cantilevered extension 155. As shown, extension 155 is split or bifurcated so as to define arms 157 and 158. Between arms 157 and 158 are established mounting ports 159-161. Although not shown in this figure, ports 159-161 are utilized to secure one or more igniters for the respective gas burner 11-15 secured to holder 126.

Figure 3:
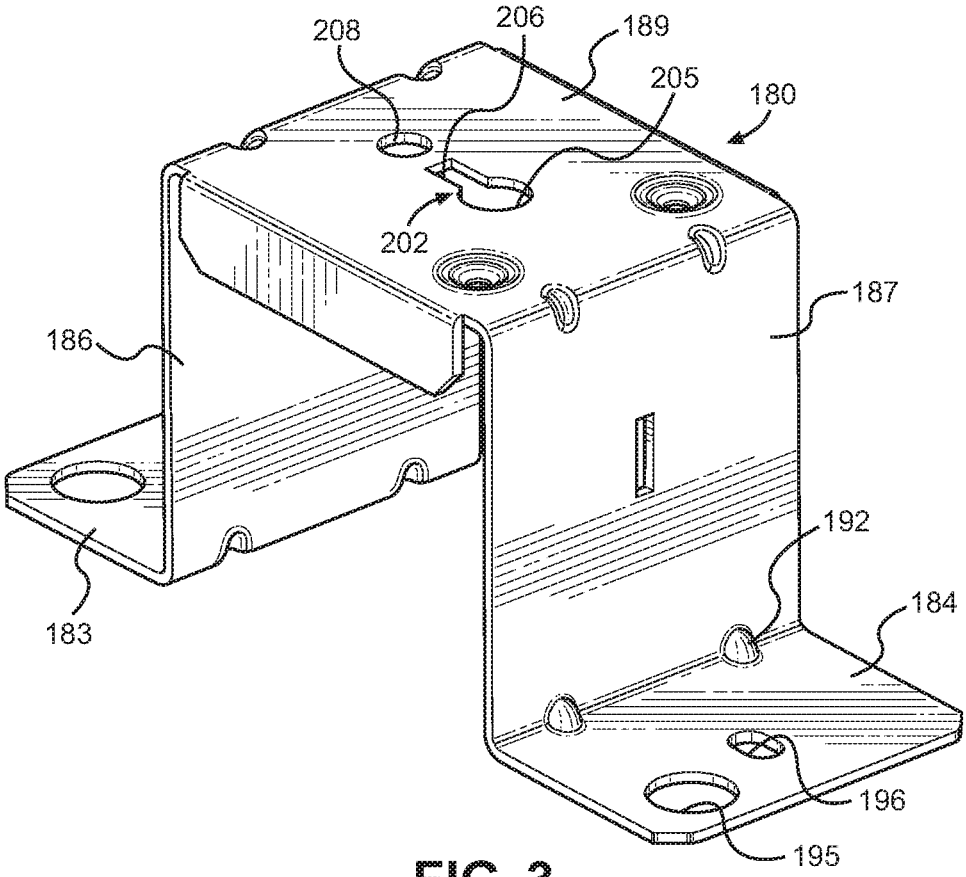
FIG. 3 is a perspective view of first support structure for the orifice holder of FIGS. 2A and 2B.
Figure 4:
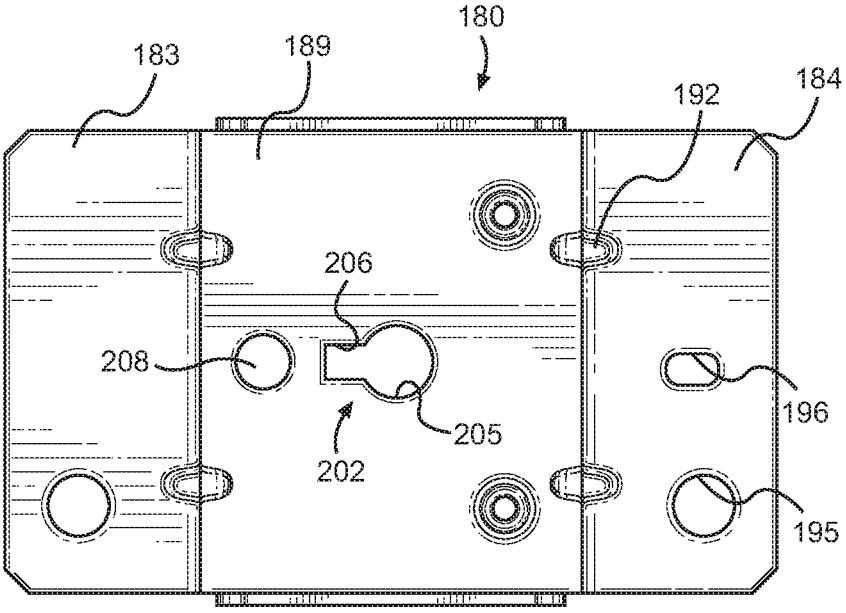
FIG. 4 is a top view of the support member of FIG. 3.

Orifice holder 126 is configured to be mounted to a support member which, in accordance with the overall invention, can take various forms. For instance, FIGS. 3 and 4 illustrate a support member in the form of a bracket 180 having base flanges 183 and 184. Projecting from base flanges 183 and 184 are upstanding legs 186 and 187 respectively. Upstanding legs 186 and 187 are interconnected by an upper cross plate 189. As shown in these figures, various internal gusset supports, such as that indicated at 192, can be provided between the base flanges 183 and 184 and upstanding legs 186 and 187, as well as between upstanding legs 186 and 187 and cross plate 189. Each of the base flanges 183 and 184 is preferably formed with at least one aperture 195, 196 for securing bracket 180 to structure below range top 8, such as a burner box which is not separately shown in two figures.

As depicted in these figures, bracket 180 includes a locator opening 202 which is shown to be centrally located in cross plate 189. As clearly indicated, locator opening 202 is polygonal in shape. More specifically, in the embodiment depicted, locator opening 202 includes a first portion 205 which is defined by a circular opening and a second portion 206 which is constituted by a polygonal (rectangular in this illustrated embodiment but could take other polygon shapes such as square, triangular and the like) opening leading directly into the circular opening. With this arrangement, first and second portions 205 and 206 combine to form locator opening 202 which is an overall polygonal-shaped opening, specifically a key-shaped opening in the most preferred embodiment shown. In addition, adjacent to, but spaced from, locator opening 202 is a hole 208.

As indicated above, with this overall structure, the anti- or non-rotational mounting feature or mechanism is employed for mounting the orifice holder, which is preferably cast of metal, such as aluminum, to a support member (also formed of metal) below a cooktop. The non-rotational mounting feature is actually established between the support member and the orifice holder which, in turn, carries the burner. More specifically, holder 126 is interengaged with the support member (bracket 180) such that holder 126 is assured or mandated to be arranged in a single, predetermined orientation so as to be appropriately positioned for proper alignment of various gas burner components, such as the gas line, electrode, and the like. More specifically, the predetermined orientation is established by inserting polygonal-shaped connecting structure 150 into a polygonal-shaped receiver defined by locator opening 202, with circular portion 151 extending into first portion 205 simultaneously with polygonal portion 152 extending into second portion 206. With each of these overall structures being polygonal, locator opening 202 can only receive holder 126 in a single orientation. Upon exacting the positioning of the holder 126 relative to the support member, holder 126 is fixed in position by a mechanical fastener (not shown) which extends from beneath cross plate 189 through hole 208 and is threaded into mounting boss 154. As will be discussed further below, a particularly advantageous embodiment of the invention employs a key-shaped anti-rotational peg and hole combination as a very compact interconnecting polygonal structural arrangement.

Figure 5:
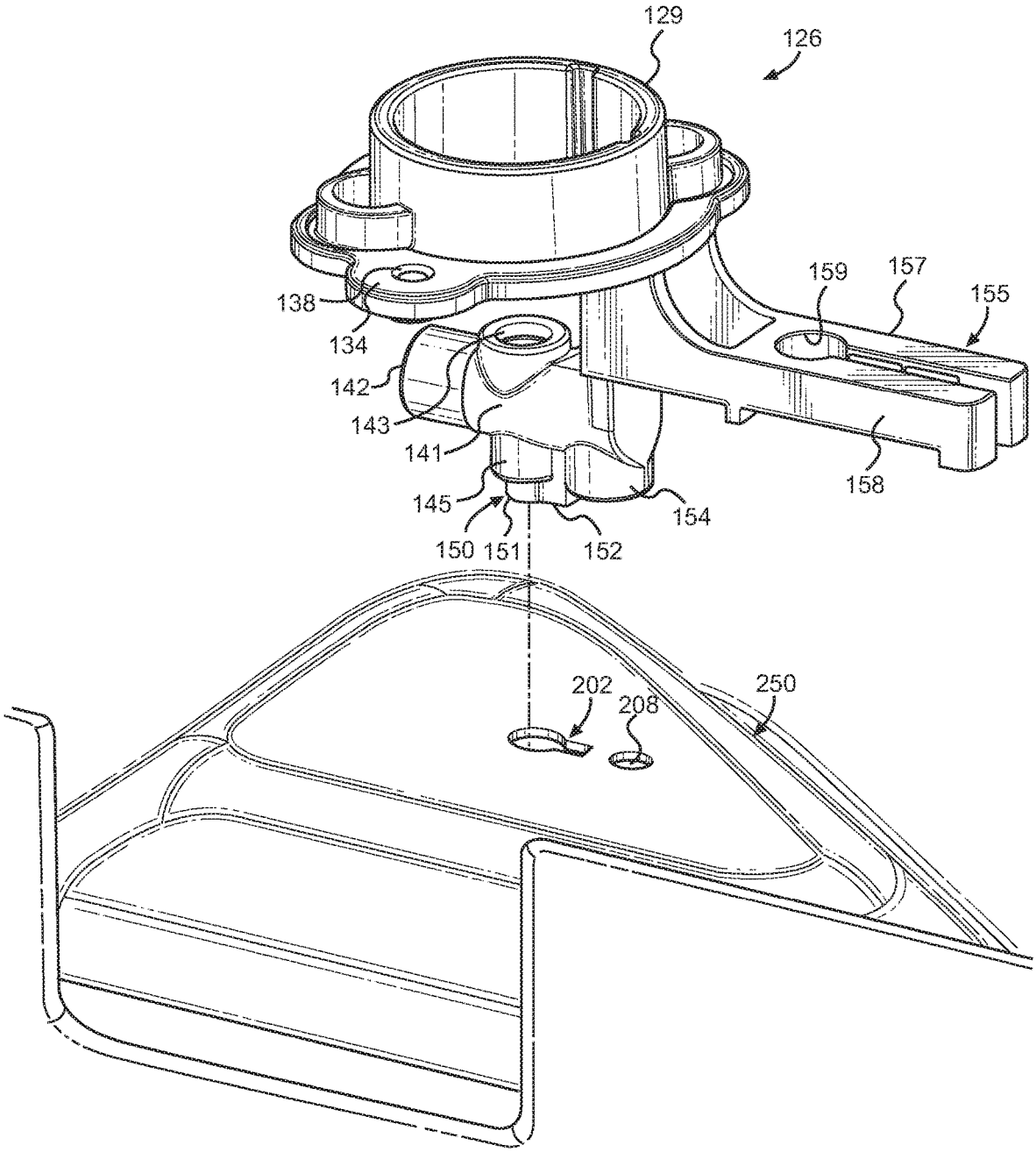
FIG. 5 is an exploded view showing the mounting of the holder to second support structure of a burner box.
Figure 6:
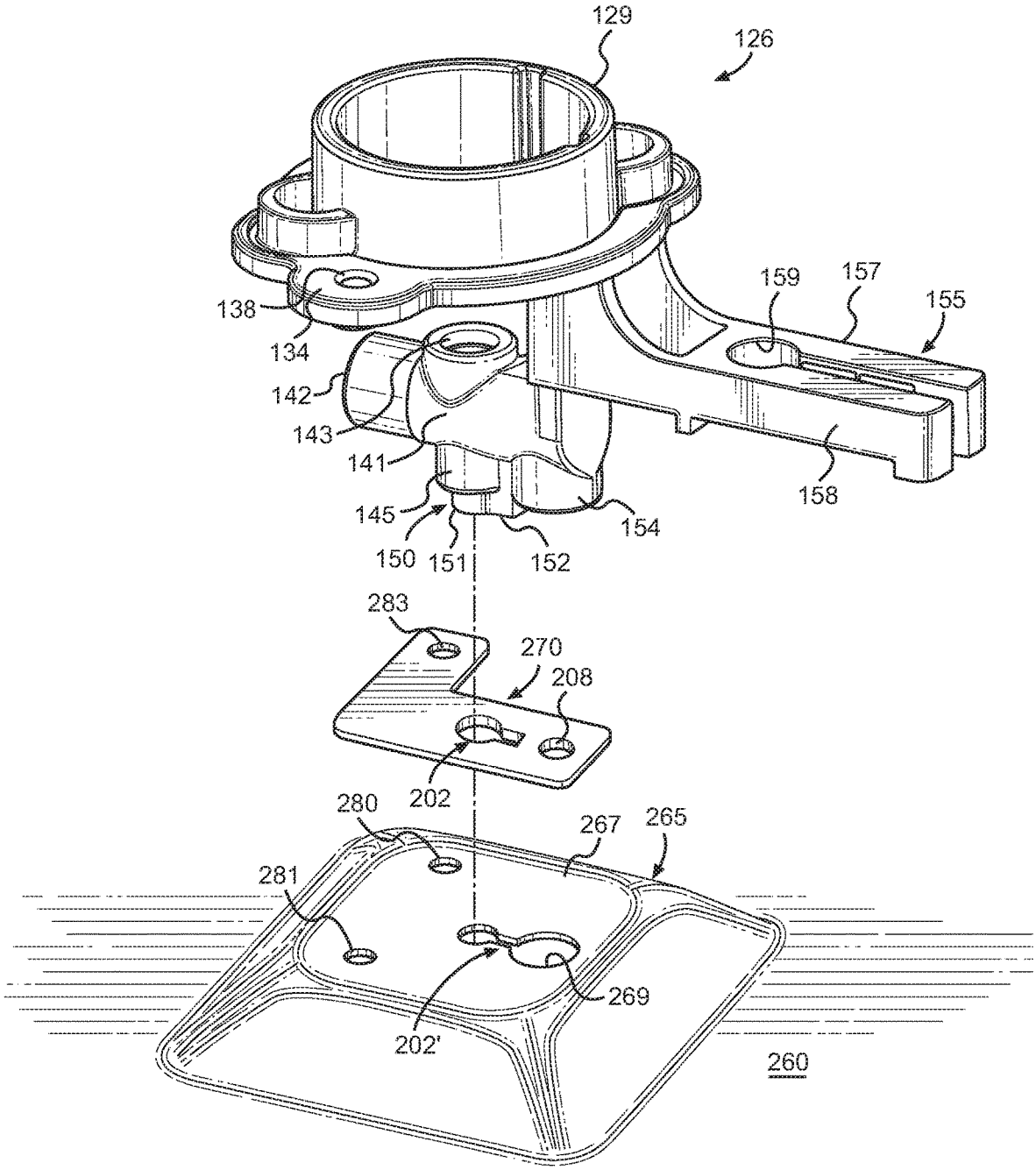
FIG. 6 is an exploded view showing the mounting of the holder to third support structure.

As indicated above, the support member can take various forms, including being constituted by bracket 180 attached to the burner box, a base of the burner box itself, or an upstanding plateau member projecting from the base of the burner box. FIG. 5 illustrates the embodiment wherein the support member is defined by a base of a burner box 250 directly in which is formed locator opening 202 and hole 208 which can accessed from below for insertion of the mechanical fastener. In the embodiment of FIG. 6, a burner box 260 is formed, preferably integrally, with an upstanding plateau member 265 having an upper surface 267 which is formed with another locator opening 202' leading into an enlarged hole 269. This embodiment also employs an additional plate 270 which includes locator opening 202. When plate 270 is employed, plate 270 is first fixed to orifice holder 126 in a predetermined orientation by inserting polygonal-shaped connecting structure 150 into locator opening 202 and then directing a mechanical fastener (not shown) from below plate 270 through hole 208 and into mounting boss 154. Thereafter, orifice holder 126 and plate 270 can be placed onto upper surface 267 with a portion of polygonal-shaped connecting structure 150 extending through locator opening 202' while a head of the mechanical fastener extending through hole 208 is freely received in enlarged hole 269. At this point, aperture 280 will be aligned with aperture 283 of plate 270 for receipt of another mechanical fastener (also not shown) to fix plate 270 and orifice holder 126 to burner box 260. Of course, depending on the particular burner location, plate 270 can be flipped to instead align apertures 281 and 283.

Based on the above, it should be readily apparent that the non-rotational mounting feature employed for mounting an orifice holder to a support member below a cooktop of a gas cooking appliance in accordance with the invention, particularly the use of mating, polygonal-shaped alignment structure such as the combination of a key-shaped projection and a key-shaped hole, mandates that the orifice holder can only be positioned relative to the support member in a single, predetermined position, thereby assuring the proper orientation of the orifice holder for the connection of the various gas burner components, regardless of the particular support structure relied upon. In addition, it should be recognized that this polygonal-shaped alignment structure is quite compact which provides for significant advantages over other potential anti-rotational mounting arrangements. For instance, the mass of the orifice holder of the present invention can be significantly reduced, in some cases by as much as 25-35% as compared to a prior proposed anti-rotational arrangement employing two spaced mounting pegs on an elongated orifice holder. In any case, although described with respect to preferred embodiments of the invention, it should still be readily apparent that various changes and/or modifications can be made to the invention without departing from the spirit thereof. For instance, it should be noted that, although the invention has been described in connection with mounting burners to a range top, the invention is equally applicable for use in mounting burners to support structure fixed below any type of cooktop. In addition, it should be recognized that some or all of the interengaging elements between the support structure and the holder could be reversed. For example, a polygonal projection could be on the support structure and a matching polygonal-shaped receiving opening provided on the orifice holder. Although different support structure embodiments have been shown and discussed, still other support structure, such as cross rails, could be utilized, particularly if a hard tool burner box is not employed. Therefore, in this regard it is simply important to note that the mounting system of the invention includes support structure fixed below a cooktop. In any event, the invention is only intended to be limited by the scope of the following claims.

I claim:

1. In a gas cooking appliance including a cooktop with a gas burner, a burner box mounted below the cooktop and an orifice holder for holding and positioning an orifice underneath the gas burner of the gas cooking appliance, the orifice holder comprising:

a mounting assembly for mounting the orifice holder to the burner box below the cooktop, said mounting assembly including a polygonal member configured to be positioned in a polygonal-shaped receiver formed in the base of the burner box to fixedly locate the orifice holder relative to the burner box in only a single, predetermined orientation.

2. The orifice holder according to claim 1, wherein the mounting assembly further includes a non-polygonal member, with the polygonal member extending from the non-polygonal member and both the polygonal member and the non-polygonal member being adapted to project into the polygonal-shaped receiver.

3. The orifice holder according to claim 2, wherein the polygonal member and the non-polygonal member define, in combination, a key-shaped anti-rotational peg.

4. The orifice holder according to claim 2, wherein the non-polygonal member is circular.

5. The orifice holder according to claim 4, wherein the polygonal member is rectangular.

6. A gas cooking appliance comprising:

a cooktop;

a burner box mounted below the cooktop;

at least one gas burner;

an orifice holder for holding and positioning an orifice underneath the at least one gas burner, the orifice holder being interposed between the burner box and the at least one gas burner; and a mounting assembly for mounting the orifice holder to the burner box, said mounting assembly including a polygonal member which is positioned in a polygonal-shaped receiver to assure fixedly locating the orifice holder relative to the burner box in only a single, predetermined orientation.

7. The gas cooking appliance according to claim 6, wherein said polygonal member projects from the orifice holder and the polygonal-shaped receiver is provided in a bracket mounted to the burner box, in a plateau member projecting upward from a base of the burner box or in a base of the burner box.

8. The gas cooking appliance according to claim 7, wherein the polygonal-shaped receiver constitutes an opening into which the polygonal member projects.

9. The gas cooking appliance according to claim 8, wherein the mounting assembly further includes a non-polygonal member, with the polygonal member extending from the non-polygonal member and both the polygonal member and the non-polygonal member projecting into the opening.

10. The gas cooking appliance according to claim 9, wherein the polygonal member and the non-polygonal member define, in combination, a key-shaped anti-rotational peg.

11. The gas cooking appliance according to claim 9, wherein the non-polygonal member is circular.

12. The gas cooking appliance according to claim 11, wherein the polygonal member is rectangular.

13. The gas cooking appliance according to claim 11, further comprising: a plate interposed between the burner box and the orifice holder, said plate including the polygonal-shaped receiver and being separately fixed to each of the orifice holder and the burner box.

14. The gas cooking appliance according to claim 6, wherein the orifice holder further includes a mounting boss configured to threadably receive a mechanical fastener for further securing the orifice holder.

15. A method of mounting an orifice holder to a burner box mounted below a cooktop in a gas cooking appliance, wherein said orifice holder is for holding and positioning an orifice underneath a gas burner of the gas cooking appliance, the method comprising:

positioning a polygonal member of the orifice holder in a polygonal-shaped receiver to assure fixedly locating the orifice holder relative to the burner box in only a single, predetermined orientation.

16. The method of claim 15, wherein positioning a polygonal member of the orifice holder in a polygonal-shaped receiver constitutes mounting the orifice holder to one of a bracket mounted to the burner box, a plateau member projecting upward from a base of the burner box or a base of the burner box.

17. The method of claim 15, wherein positioning a polygonal member of the orifice holder in a polygonal-shaped receiver includes inserting a polygonal-shaped peg projecting from the orifice holder into a polygonal-shaped opening.

18. The method of claim 17, wherein inserting the polygonal-shaped peg projecting from the orifice holder into the polygonal-shaped opening constitutes inserting a key-shaped anti-rotational peg into a key-shaped opening.

19. The method of claim 15, further comprising:

fixing a plate, including the polygonal-shaped receiver, to the orifice holder; and further fixing the plate to the burner box such that the plate is interposed between the burner box and the orifice holder.

20. The method of claim 15, wherein the orifice holder further includes a non-polygonal member, with the non-polygonal member being circular and extending directly from the polygonal member, and wherein positioning a polygonal member of the orifice holder in a polygonal-shaped receiver is performed by simultaneously inserting the polygonal and non-polygonal members into the polygonal-shaped receiver.

* * * * *